US008366108B2

(12) United States Patent
Coronas Coma et al.

(10) Patent No.: US 8,366,108 B2
(45) Date of Patent: Feb. 5, 2013

(54) APPARATUS FOR PLAYING BY MEANS OF LAUNCHING PROJECTILES

(75) Inventors: Ivan Coronas Coma, Molins de Rei (ES); Joan Noguer de Palol, Sant Gregori (ES)

(73) Assignee: IMC Toys, S.A., Terrassa (ES)

( * ) Notice: Subject to any disclaimer, the term of this patent is extended or adjusted under 35 U.S.C. 154(b) by 0 days.

(21) Appl. No.: 13/155,956

(22) Filed: Jun. 8, 2011

(65) Prior Publication Data

US 2011/0304096 A1 Dec. 15, 2011

(30) Foreign Application Priority Data

Jun. 10, 2010 (ES) ..... 201030903

(51) Int. Cl.
*A63F 7/30* (2006.01)
*A63F 7/00* (2006.01)

(52) U.S. Cl. ..... 273/127 R; 273/127 D; 273/118 R; 273/119 R

(58) Field of Classification Search ..... 273/108, 273/11 R, 118 A, 119 R, 119 A, 121 R, 121 A, 273/127 R, 127 A, 127 D, 129 R, 129 V, 273/129 W, 317
See application file for complete search history.

(56) References Cited

U.S. PATENT DOCUMENTS

| | | | | |
|---|---|---|---|---|
| 3,792,859 | A * | 2/1974 | Gybowski et al. | 473/76 |
| 3,947,028 | A * | 3/1976 | Goldfarb et al. | 473/76 |
| 4,867,454 | A * | 9/1989 | Horvath et al. | 273/119 R |
| 7,837,197 | B2 * | 11/2010 | Kishon et al. | 273/119 R |
| 8,157,264 | B2 * | 4/2012 | Kishon et al. | 273/119 R |
| 8,215,639 | B2 * | 7/2012 | Kishon et al. | 273/119 R |
| 2009/0230620 | A1 * | 9/2009 | Kishon et al. | 273/119 R |
| 2011/0304096 | A1 * | 12/2011 | Coronas Coma et al. | 273/127 R |

FOREIGN PATENT DOCUMENTS

| | | | |
|---|---|---|---|
| CN | 201426965 | Y | 3/2010 |
| EP | 1976603 | A1 | 10/2008 |
| GB | 155939 | A | 1/1921 |
| JP | 2004-358068 | A | 12/2004 |
| WO | 2009/100693 | A1 | 8/2009 |

OTHER PUBLICATIONS

Spanish Search Report dated Oct. 17, 2012 issued in a corresponding Spanish Patent Application No. 201030903.

* cited by examiner

*Primary Examiner* — Raleigh W. Chiu
(74) *Attorney, Agent, or Firm* — Sughrue Mion, PLLC

(57) ABSTRACT

The present invention relates to an apparatus for playing by means of launching projectiles, comprising at least one projectile propulsion device for propelling projectiles which slide on a playing surface; a raised substrate below which the launched projectiles circulate; and a set of playing pieces, the substrate being provided with means for the detachable support of the mentioned playing pieces comprising a pedestal on which at least one playing piece is stably placed; and a corresponding actuation lever, rotatably mounted with respect to the substrate, the power arm of which extends below the substrate and is susceptible to being hit by one of the propelled projectiles, forcing the lever to suddenly rotate about its rotation shaft such that it drives the rotating pedestal or the piece placed on it.

13 Claims, 4 Drawing Sheets

APPARATUS FOR PLAYING BY MEANS OF LAUNCHING PROJECTILES

CROSS REFERENCE TO RELATED APPLICATION

This application relates to and claims the benefit of priority from Spanish Patent Application number P 201030903, filed on Jun. 10, 2010, the entire disclosure of which is incorporated herein by reference.

TECHNICAL FIELD OF THE INVENTION

The invention relates to an apparatus for playing by means of launching projectiles, of the type comprising one or several projectile propulsion devices, a playing surface on which the propelled projectiles slide, a raised substrate covering the playing surface, below which the launched projectiles circulate, and a set of playing pieces which are placed on said substrate in order to somehow be knocked down or displaced by the propelled projectiles.

BACKGROUND OF THE INVENTION

Patent document EP 1976603 discloses an apparatus for playing by means of launching projectiles in the form of balls comprising two ball propulsion devices and a playing surface on which the projected balls slide.

The apparatus has a horizontal substrate that is raised with respect to the playing surface, provided with a series of apertures in which the playing pieces are inserted with a certain tightness such that they remain erect while they are duly inserted in the substrate and the pegs of the pieces housed in the apertures of the substrate project or protrude below the level of said substrate.

In the game, the propulsion devices must be operated so that the launched projectiles hit the pegs of the aforementioned pieces, such that they cause them to be dislodged from the apertures of the substrate and accordingly, the playing pieces do not remain erect, being able to notify the players that a projectile has hit one of the pieces.

The apparatus described above has several drawbacks that the present invention seeks to resolve.

Firstly, it is observed that the pieces are not satisfactorily released or dislodged from the substrate when hit by a ball. This is because the main component of the force transmitted by a ball when it hits the peg of a piece follows a direction that is essentially parallel to that of the path of the ball, in other words essentially perpendicular to the peg of the piece, whereas in order to dislodge a piece, the ideal direction that the force must follow is vertical, in the direction in which the peg must be displaced in order to dislodge it from its corresponding aperture. Accordingly, despite the fact that a peg is hit by a ball it is possible that the corresponding piece is not duly dislodged from the substrate.

In addition, despite the fact that a piece is dislodged from the substrate, it is knocked down on the same substrate, making it difficult to see the game when the substrate is transparent.

Therefore, an objective of the present invention is an apparatus in which when the projectiles reach a predetermined target it is assured that the associated playing piece or pieces are dislodged from the substrate. Another objective of the present invention is an apparatus whereby said dislodged pieces do not remain on the substrate, or at least on the part of the substrate arranged immediately above the playing surface.

According to another objective of the present invention, a suitable solution is sought so that rather than the pieces being merely knocked down, they are flung out of or expelled from their original position with sufficient force so that they fall off the substrate, increasing the feeling of having hit the target.

DISCLOSURE OF THE INVENTION

The apparatus according to the invention is of the type comprising at least one projectile propulsion device for propelling projectiles such as discs or balls, and a playing surface on which the propelled projectiles slide or above which the said propelled projectiles skim, the apparatus further comprising a raised substrate covering the playing surface, below which the launched projectiles circulate, and a set of playing pieces, the substrate being provided with means for the detachable support of the mentioned playing pieces.

Essentially, the apparatus of the invention is characterized in that said means for the detachable support of the playing pieces comprise a pedestal on which at least one playing piece is stably placed; and an actuation lever, rotatably mounted with respect to the substrate, the power arm of which extends below the substrate and is susceptible to being hit by one of the propelled projectiles, forcing the lever to suddenly rotate about its rotation shaft, the actuation lever being provided with pushing means which, when the mentioned rotation of the actuation lever takes place, displace the pedestal or directly the piece or pieces placed on it enough to cause the detachment of said pieces with respect to the corresponding pedestal.

According to a variant of the invention, the pedestal on which at least one playing piece is stably placed is a rotating pedestal, rotating with respect to the substrate, and the pushing means of the actuation lever drive the rotating pedestal to cause the rotation thereof and to expel the playing piece or pieces placed on it.

According to another feature of this variant, the rotating pedestal and the corresponding actuation lever are independent bodies with the capacity to rotate about respective parallel, preferably horizontal, rotation shafts such that when the rotating pedestal is driven, the piece or pieces placed on it are catapulted off the substrate.

According to another feature of the invention, the power arm of the actuation lever comprises an end portion in the form of a plate, oriented essentially transverse to the straight path joining the propulsion device with the actuation lever, and the front face of which is intended for being hit by the projectile.

The rear face of the plate of the power arm of the actuation lever, opposite the face which is intended for being hit by the projectile, preferably has a convex-curved cross-section for the purpose of preventing the projectiles from being able to be stably supported against the mentioned rear face.

According to another feature, the pedestal being a rotating pedestal, the actuation lever is a lever of the first order provided with a resistance arm carrying out the function of the pushing means, pushing and driving the rotating pedestal when the actuation lever rotates as the power arm is hit by a projectile.

According to one embodiment, the actuation lever is made of a single part, being provided with two opposing cylindrical projections which, like a shaft, fit in respective bushes formed in the substrate to guide the rotational movement of the actuation lever.

According to another feature of interest, the resistance arm forms an angle with the power arm, and the actuation lever is configured such that it adopts automatically and due to the effect of gravity a stand-by position in which the resistance arm is in contact with the lower part of the rotating pedestal.

According to another feature of the invention, the actuation lever is provided with a front flange cooperating with a corresponding protrusion of the substrate acting like a stop to prevent the actuation lever from exceeding a predetermined angular position upon rotating in the direction opposite to that of its actuation on the pedestal.

According to another feature of the invention, the rotating or non-rotating pedestal is provided with at least one aperture in which a peg or projection provided on the playing pieces tightly fits.

In another variant of interest of the invention, when the pedestal is fixed, the peg or projection of the playing piece sticks out through the lower mouth of the aperture of the pedestal and the pushing means of the actuation lever comprise an upper cam arranged immediately below said projection, the profile of which is suitable for transmitting the rotational movement of the actuation lever to the projection, which acts like a cam follower, raising it and accordingly dislodging the piece from the aperture.

In another variant of the invention, the rotation shaft of the actuation lever is horizontally displaced with respect to the peg or projection of the piece, the length of the power arm of said actuation lever being sufficient so that when the rotation of the mentioned actuation lever takes place, the latter strikes the peg or projection of the piece, raising it and accordingly dislodging the piece from the aperture.

In a preferred embodiment of the apparatus intended for two players, it comprises at least a first and a second projectile propulsion devices, both operable and placed mutually facing one another at respective ends of the playing surface, a first group and a second group of means for the detachable support of the playing pieces being distinguished, each associated with a corresponding propulsion device such that the projectiles propelled from the first propulsion device can reach the front face of the actuation lever of any of the means for the detachable support of the pieces of the first group following a straight path, forcing said lever to rotate in the direction in which it displaces its corresponding pedestal, and such that the projectiles propelled from the second propulsion device (3*b*) can reach the front face of the actuation lever of any of the means for the detachable support of the pieces of the second group following a straight path, forcing said lever to rotate in the direction in which it displaces its corresponding pedestal.

BRIEF DESCRIPTION OF THE DRAWINGS

Three variants of an apparatus according to the invention are illustrated by way of non-limiting example in the attached drawings. Specifically.

DETAILED DESCRIPTION OF THE DRAWINGS

Figure 1:
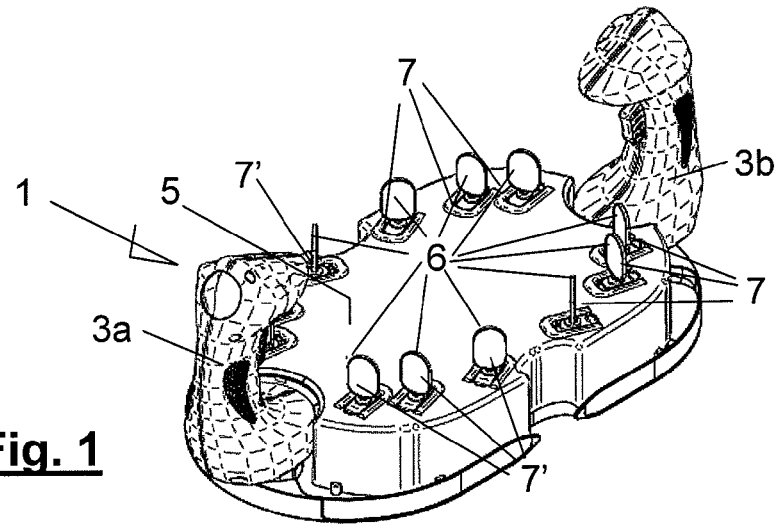
FIG. 1 is a plan view of a first variant for an apparatus according to the invention.

FIG. 1 shows an apparatus 1 comprising a first and a second projectile propulsion devices 3*a* and 3*b*, respectively, both operable and placed mutually facing one another at respective ends of a playing surface 4 (see FIGS. 4*a* to 4*d*) on which a transparent substrate 5 is arranged in which a first and a second groups of means for the detachable support 7 and 7' of playing pieces 6 are distributed, in each of which a corresponding playing piece 6 which is originally maintained erect on the substrate 5 is detachably coupled.

The apparatus 1 is suitable for playing by means of launching projectiles and such that the operator of the propulsion device 3*a* can propel projectiles against any one of the means for the detachable support 7 of playing pieces 6 of the first group to cause the detachment of the associated pieces 6, and such that the operator of the propulsion device 3*b* can propel projectiles against any one of the means for the detachable support 7' of playing pieces 6 of the second group to cause the detachment of the associated pieces 6. Conventionally, whoever dislodges the greater number of pieces 6 wins the game.

Figure 2:
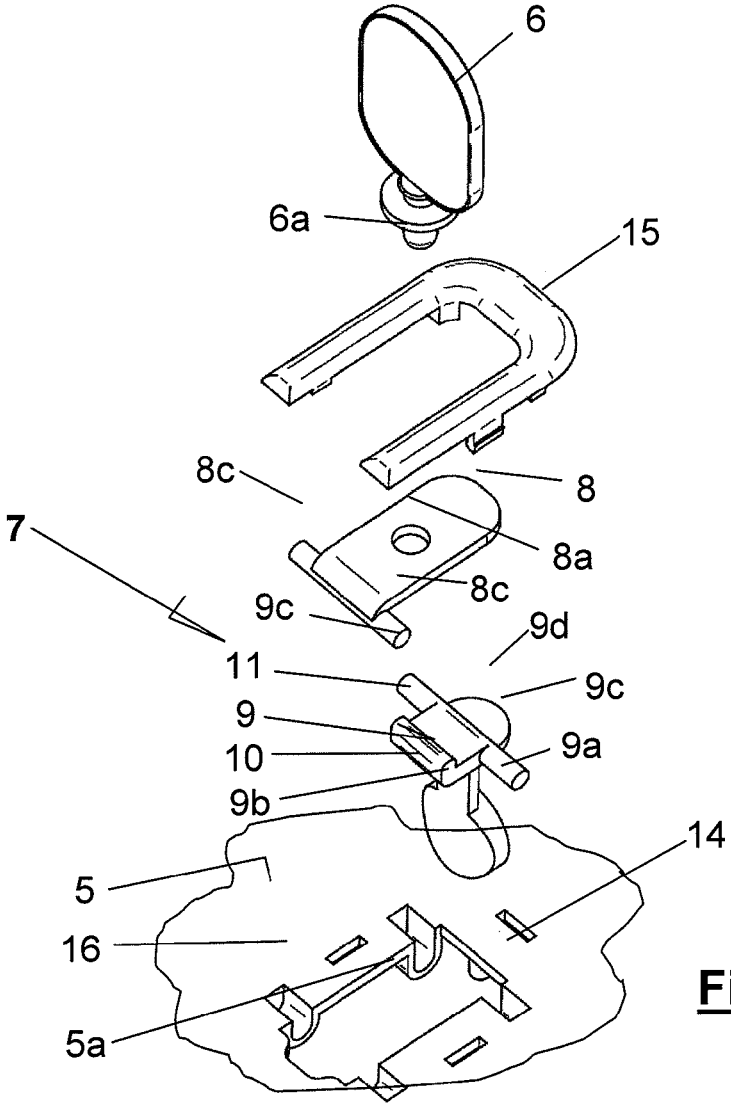
FIG. 2 is an exploded view of the means for the detachable support of a playing piece of the apparatus of FIG. 1.

Each of the means for the detachable support 7, 7' of the pieces 6 is placed in an opening 5*a* of the substrate 5, and it comprises, according to the variant depicted in FIG. 2, a pedestal 8, rotating with respect to the substrate 5, provided with an aperture 8*a* in which a peg or projection 6*a* of a playing piece 6 tightly fits; and a corresponding actuation lever 9, also rotatably mounted with respect to the substrate 5, the power arm 10 of which extends below said substrate 5.

It is observed in the depicted variant that the pedestal 8 and the corresponding actuation lever 9 are independent bodies with the capacity to rotate about respective horizontal rotation shafts 13 and 12.

Figures 4A, 4B, 4C, 4D:
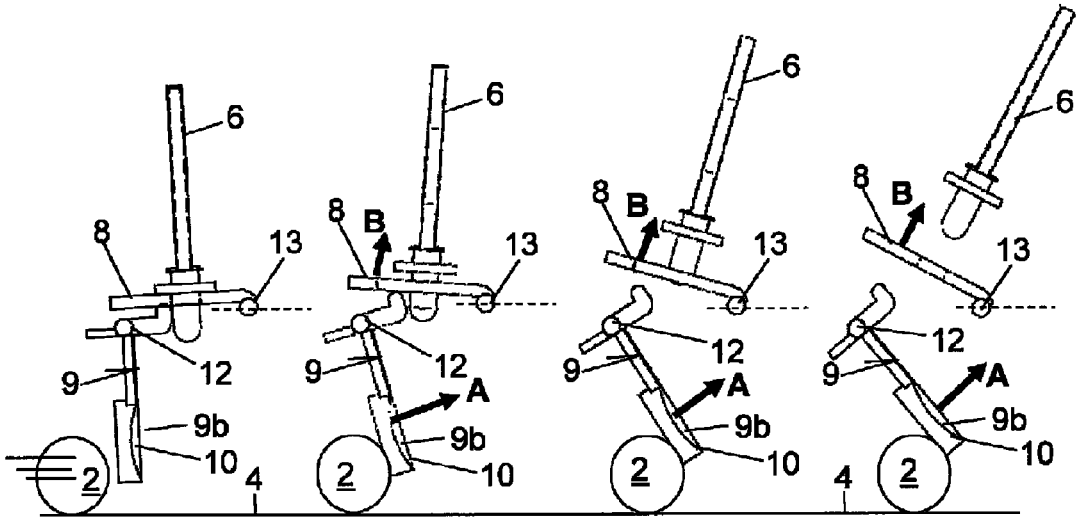
FIGS. 4*a*, 4*b*, 4*c* and 4*d* are a sequence of the operation of the means for the support of a piece when the actuation lever is hit by a projectile.

The operation of the means for the detachable support 7 of the pieces 6 is explained in greater detail below:

Starting from the situation depicted in FIG. 4*a*, in which the rotating pedestal 8 adopts an essentially horizontal position, when a projectile 2, depicted in the form of a ball, sliding on the playing surface 4 or skimming the said playing surface 4 hits the power arm 10 of the actuation lever 9, said actuation lever 9 is suddenly displaced and rotates about its horizontal shaft 12 in the direction indicated by the arrows A of FIGS. 4*b* to 4*d*. It is observed that the resistance arm 11 of the actuation lever 9 is raised and, by pushing, displaces the rotating pedestal 8 (see FIGS. 4*b* to 4*d*), forcing it to rotate in the direction indicated by the arrow B of FIG. 4*b* about its rotation shaft 13. In practice, the force exerted by the projectile 2 on the actuation lever 9 causes the rotating pedestal 8 to be driven such that the piece 6 placed on it is catapulted, being detached from the pedestal 8. In addition, upon rotating the pedestal 8 in the direction opposite to the actuation lever 9, the piece 6 is launched in the direction followed by the projectile 2, being launched off the substrate 5. To favor this result, it is preferably to arrange the means for the detachable coupling 7, 7' of the pieces 6 in the contour of the substrate 5.

Returning to FIG. 2, it is observed that the power arm 10 of the actuation lever 9 comprises an end portion in the form of a plate performing the function of a target in order to make the game less difficult. Said plate is preferably oriented essentially transverse to the straight path joining the associated propulsion device 3*a* or 3*b* with the actuation lever 9. It is further observed that the rear face 9*b* of the power arm 10 of the actuation lever 9, opposite the front face 9*a* that is intended for being hit by the projectile 2, has a convex-curved cross-section for the purpose of preventing the projectiles 2 from being able to be stably supported against the mentioned rear face 9*b*.

Figure 3:
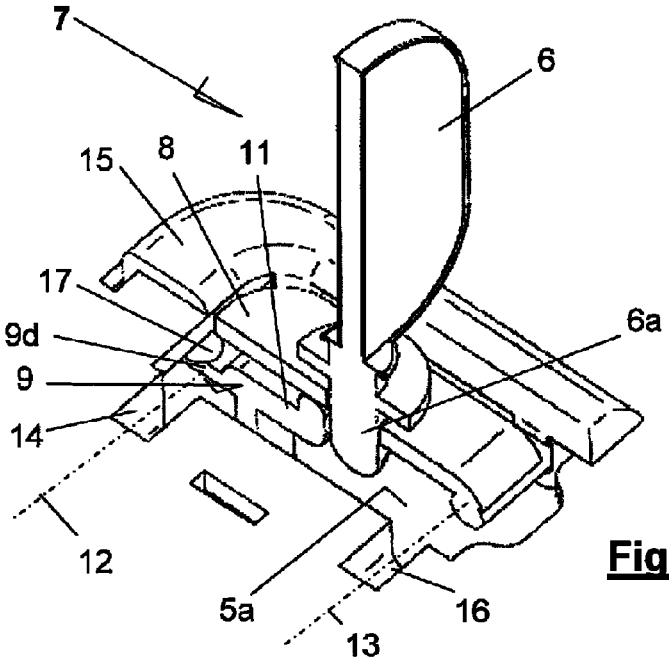
FIG. 3 is a view of the components of FIG. 2 partially sectioned and duly coupled to one another and to the substrate of the apparatus.

In the depicted example, the actuation lever 9 is made of a single part, being provided with two opposing cylindrical projections 9*c* which, like a shaft, fit under pressure in respective bushes 14 formed in the substrate 5 to guide the rotational movement of the actuation lever 9, as shown in FIG. 3. Similarly, the rotating pedestal 8 is also provided with respective cylindrical projections 8*c* intended for fitting in corresponding recesses or bushes 16 also formed in the substrate 5. To prevent the dislodging of the projections 9*c* and 8*c* of the actuation lever 9 and of the pedestal 8, respectively, from the recesses or bushes 14 and 16 formed in the substrate 5, a frame 15 blocking the opening of the bushes 14 and 16, also being an adornment and hiding the contour of the opening 5*a* of the substrate 5 housing the assembly formed by the actuation lever 9 and the pedestal 8 is arranged on the substrate 5.

It is further noted that the actuation lever 9 is configured such that it adopts automatically and due to the effect of gravity a stand-by position in which its resistance arm 11, which forms an angle with the power arm 10, is in contact with the lower part of the rotating pedestal 8 when the latter adopts its horizontal position before the actuation lever 9 is hit by a projectile 2. Concerning the rotating pedestal 8, after being displaced by the actuation lever 9, it generally adopts a knocked down position about its rotation shaft 13, supported on an inner edge of the frame 15, or due to the rebound effect upon striking the mentioned frame 15 it automatically adopts its original horizontal position again. For the purpose of preventing the weight of the pedestal 8, or any force exerted from outside the substrate 5, from being able to displace the actuation lever 9 from its stand-by position in a rotation direction opposite that of the arrow A of FIG. 3*a*, it is observed that the actuation lever 9 is provided with a front flange 9*d* cooperating with a corresponding protrusion 17 of the substrate 5, which is projected downwards and acts like a stop, preventing the actuation lever 9 from exceeding a predetermined angular position upon rotating in the aforementioned direction, opposite that of its actuation on the pedestal 8.

Figure 5:
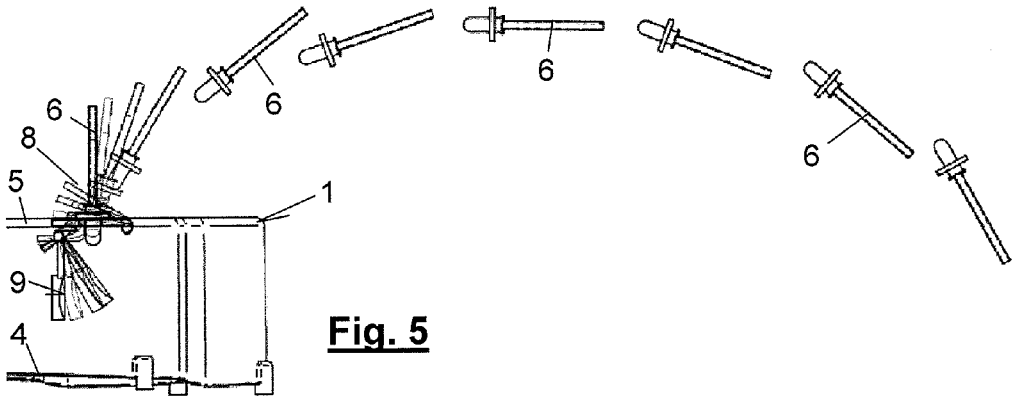
FIG. 5 illustrates the effect produced in a playing piece when a projectile hits an associated target.

Naturally, the operation of the apparatus does not change in the event of orienting the rotation shaft of the actuation lever 9 and of the pedestal 8 such that they are arranged forming an angle with the horizontal. Nevertheless, the horizontal orientation is what produces a greater effect on the users of the apparatus 1 indicating that they have hit the target, because the pieces 6 are catapulted (see FIG. 5), reaching a maximum distance off the substrate 5.

Figure 6:
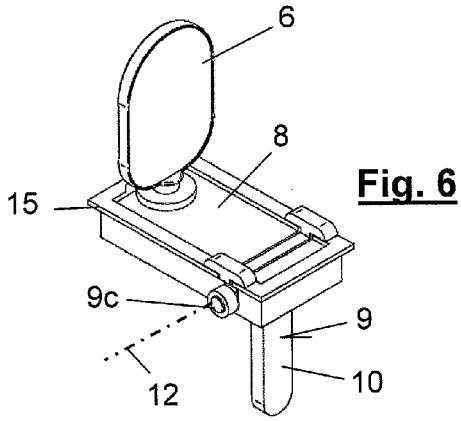
FIG. 6 is a perspective view of the means for the detachable support of a playing piece according to a second variant of the invention.
Figure 8:
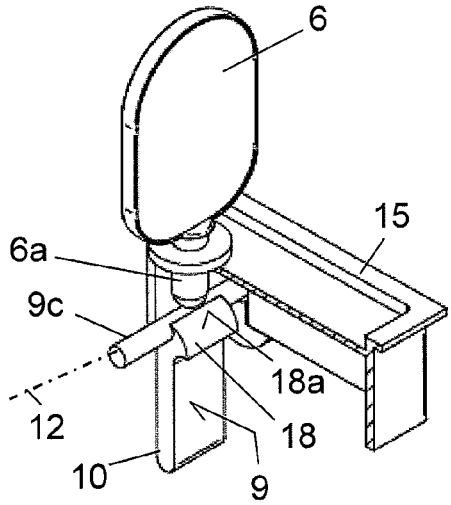
FIG. 8 is a perspective view partially sectioned according to a longitudinal plane of section of the means for the detachable support of a playing piece according to a third variant of the invention.
Figures 9A, 9B, 9C, 9D:
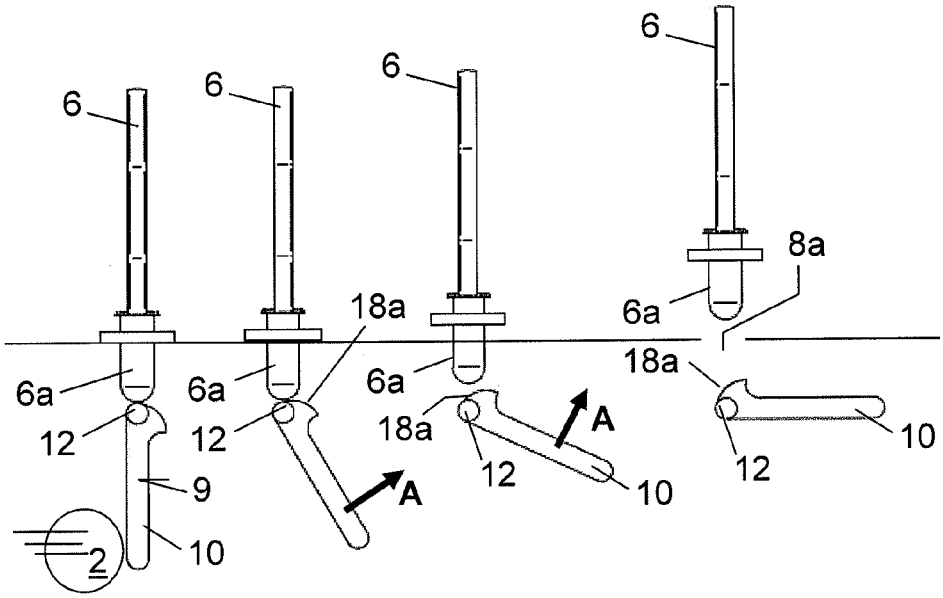
FIGS. 9*a*, 9*b*, 9*c* and 9*d* are a sequence of the operation of this third variant of the means for the detachable support of a playing piece.

FIGS. 6 and 8 depict second and third embodiment variants of the invention, the means for the detachable support of the playing pieces 6 of which differ from the variant explained above in that the pedestal 8 is fixed. Said pedestal 8, also provided with a corresponding aperture 8*a* in which a peg or projection 6*a* of provided on the playing pieces 6 tightly fits, can be formed in the substrate 5 itself, forming an integral part therewith, or it can be formed in a separate body coupleable to the substrate 5.

In any case, it can be observed in both variants that the peg or projection 6*a* of the playing piece 6 sticks out through the lower mouth of the aperture 8*a* of the pedestal 8 so that the projection 6*a* can directly contact the actuation lever to displace the playing piece 6 when said lever is forced to rotate as it is hit by a projectile 2. The variants of FIGS. 6 and 8 differ from one another in the shape and arrangement adopted by the pushing means of said actuation lever 9.

In the variant of FIG. 6, the actuation lever 9 is rotatably mounted about the rotation shaft 12. To do so, it is envisaged that the actuation lever 9 be provided with respective cylindrical projections 9*c* that are housed in corresponding bushes or recess provided for that purpose either in the substrate 5 or in the frame 15 which, like in the variant of FIGS. 1 to 5, is placed in a corresponding opening 5*a* made in the substrate 5.

Figures 7A, 7B, 7C, 7D:
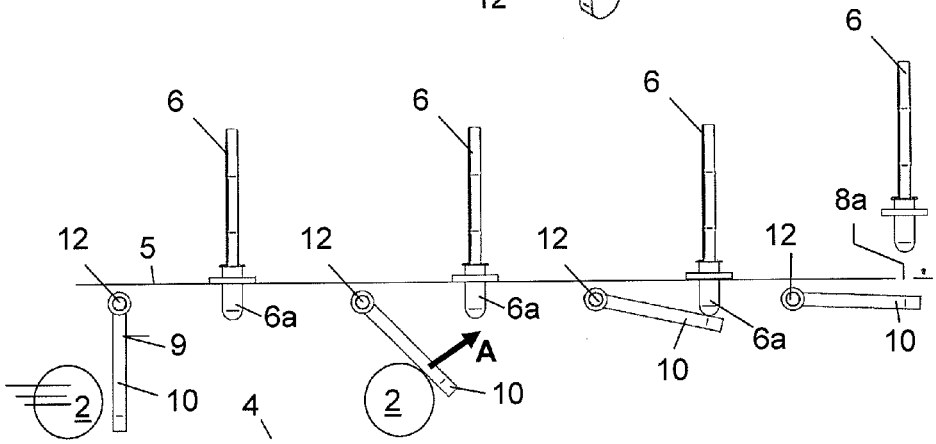
FIGS. 7*a*, 7*b*, 7*c* and 7*d* are a sequence of the operation of this second variant of the means for the detachable support of a playing piece.

In the sequence of FIGS. 7*a* to 7*d*, it is observed that the peg or projection 6*a* of the playing piece 6 sticks out through the lower mouth of the aperture 8*a* (see FIG. 7*d*) of the pedestal 8, and that the rotation shaft 12 of the actuation lever 9 is horizontally displaced with respect to the peg or projection 6*a* of the piece 6, the length of the power arm 10 of said actuation lever 9 being sufficient so that when the rotation of the mentioned actuation lever 9 in the direction indicated by the arrow A of FIG. 7*b* takes place, the latter strikes the peg or projection 6*a* of the piece 6, raising it and accordingly dislodging the piece 6 from the aperture 8*a*. In summary, the pushing means of the actuation lever 9 are formed by a rear end portion of the power arm 10 of the actuation lever 9 itself.

In the variant of FIG. 8, the rotation shaft of the actuation lever is placed essentially in the vertical projection of the peg 6*a* of the piece 6. It is observed that the pushing means of the actuation lever 9 are formed by an upper portion configured in the form of a cam 18 which is arranged immediately below said projection 6*a*. As shown in the sequence of FIGS. 9*a* to 9*d*, the profile 18*a* of the cam 18 is designed to transmit the rotational movement of the actuation lever 9, in the direction indicated by the arrows A of FIGS. 9*b* and 9*c*, to the projection 6*a*, which acts like a cam follower, causing it to be raised and the piece 6 accordingly being dislodged from the aperture 8*a*.

The invention claimed is:

1. An apparatus for playing by means of launching projectiles, comprising at least one projectile propulsion device for propelling projectiles such as discs or balls, and a playing surface on which the propelled projectiles slide or above which the propelled projectiles skim, the apparatus further comprising a raised substrate covering the playing surface, below which the launched projectiles circulate, and a set of playing pieces, the substrate being provided with means for the detachable support of the mentioned playing pieces, characterized in that said means for the detachable support of the playing pieces comprise a pedestal on which at least one playing piece is stably placed; and an actuation lever, rotatably mounted with respect to the substrate, the power arm of which extends below the substrate and is susceptible to being hit by one of the propelled projectiles, forcing the lever to suddenly rotate about its rotation shaft, the actuation lever being provided with pushing means which, when the mentioned rotation of the actuation lever takes place, displace the pedestal or directly the piece or pieces placed on it enough to cause the detachment of said pieces with respect to the corresponding pedestal.

2. The apparatus according to claim 1, characterized in that the pedestal on which at least one playing piece is stably placed is a rotating pedestal, rotating with respect to the substrate; and in that the pushing means of the actuation lever drive the rotating pedestal to cause the rotation thereof and to expel the playing piece or pieces placed on it.

3. The apparatus according to claim 2, characterized in that the rotating pedestal and the corresponding actuation lever are independent bodies with the capacity to rotate about respective parallel, preferably horizontal, rotation shafts such that when the rotating pedestal is driven, the piece or pieces placed on it are catapulted off the substrate.

4. The apparatus according to claim 2, characterized in that the actuation lever is a lever of the first order provided with a resistance arm carrying out the function of pushing means, pushing and driving the rotating pedestal when the actuation lever rotates as the power arm is hit by a projectile.

5. The apparatus according to claim 4, characterized in that the actuation lever is made of a single part, being provided with two opposing cylindrical projections which, like a shaft, fit in respective bushes formed in the substrate to guide the rotational movement of the actuation lever.

6. The apparatus according to claim 4, characterized in that the resistance arm forms an angle with the power arm, and in that the actuation lever is configured such that it adopts automatically and due to the effect of gravity a stand-by position in which the resistance arm is in contact with the lower part of the rotating pedestal.

7. The apparatus according to claim 2, characterized in that the actuation lever is provided with a front flange cooperating with a corresponding protrusion of the substrate acting like a stop to prevent the actuation lever from exceeding a predetermined angular position upon rotating in the direction opposite to that of its actuation on the pedestal.

8. The apparatus according to claim 1, characterized in that the power arm of the actuation lever comprises an plate oriented essentially transverse to the straight path joining the propulsion device with the actuation lever, the front face of which is intended for being hit by the projectile.

9. The apparatus according to claim 8, characterized in that the rear face of the plate of the power arm of the actuation lever, opposite the face which is intended for being hit by the projectile has a convex-curved cross-section for the purpose of preventing the projectiles from being able to be stably supported against the mentioned rear face.

10. The apparatus according to claim 1, characterized in that the pedestal is provided with at least one aperture in which a peg or projection provided on the playing pieces tightly fits.

11. The apparatus according to claim 10, characterized in that the peg or projection of the playing piece sticks out through the lower mouth of the aperture of the pedestal, and in that the pushing means of the actuation lever comprise an upper cam arranged immediately below said projection and the profile of which is suitable for transmitting the rotational movement of the actuation lever to the projection which acts like a cam follower, raising it and accordingly dislodging the piece from the aperture.

12. The apparatus according to claim 10, characterized in that the peg or projection of the playing piece sticks out through the lower mouth of the aperture of the pedestal, and in that the rotation shaft of the actuation lever is horizontally displaced with respect to the peg or projection of the piece, the length of the power arm of said actuation lever being sufficient so that when the rotation of the mentioned actuation lever takes place, the latter strikes the peg or projection of the piece, raising it and accordingly dislodging the piece from the aperture.

13. The apparatus according to claim 1, characterized in that it comprises at least a first and a second projectile propulsion devices for propelling projectiles, both operable and placed mutually facing one another at respective ends of the playing surface, and in that a first group and a second group of means for the detachable support of the playing pieces are distinguished, each associated with a corresponding propulsion device such that the projectiles propelled from the first propulsion device can reach the front face of the actuation lever of any of the means for the detachable support of the pieces of the first group following a straight path, forcing said lever to rotate in the direction in which it displaces its corresponding pedestal, and such that the projectiles propelled from the second propulsion device can reach the front face of the actuation lever of any of the means for the detachable support of the pieces of the second group following a straight path, forcing said lever to rotate in the direction in which it displaces its corresponding pedestal.

* * * * *